US005739737A

United States Patent [19]

Hatton

[11] Patent Number: 5,739,737

[45] Date of Patent: Apr. 14, 1998

[54] BLOWN FUSE INDICATOR

[76] Inventor: Ken W. Hatton, 2129 W. Giddings, Chicago, Ill. 60625

[21] Appl. No.: 639,899

[22] Filed: Apr. 29, 1996

[51] Int. Cl.[6] ..... H01H 85/30; G08B 21/00

[52] U.S. Cl. ..... 337/206; 337/241; 340/638; 340/639

[58] Field of Search ..... 337/142, 186, 337/198, 206, 4, 241; 340/638, 639

[56] References Cited

U.S. PATENT DOCUMENTS

| | | | |
|---|---|---|---|
| 4,281,322 | 7/1981 | Nasu et al. | 340/638 |
| 4,349,813 | 9/1982 | Ishibashi et al. | 340/638 |
| 4,484,185 | 11/1984 | Graves | 340/656 |
| 4,514,723 | 4/1985 | Lean | 340/638 |
| 4,673,928 | 6/1987 | Guim | 340/638 |
| 4,760,384 | 7/1988 | Vila-Masot | 340/638 |
| 5,002,501 | 3/1991 | Tucker | 439/417 |
| 5,002,505 | 3/1991 | Jones et al. | 439/622 |
| 5,242,318 | 9/1993 | Plass | 439/620 |
| 5,300,913 | 4/1994 | Linton | 337/242 |
| 5,306,180 | 4/1994 | Buhr | 439/620 |
| 5,331,505 | 7/1994 | Wilheim | 361/306.3 |
| 5,336,115 | 8/1994 | Paulus | 439/620 |
| 5,340,334 | 8/1994 | Nguyen | 439/620 |

*Primary Examiner*—Donald Sparks
*Assistant Examiner*—Jay Prakash N. Gandhi
*Attorney, Agent, or Firm*—Friscia & Nussbaum

[57] ABSTRACT

A fuse box is provided with LED's interconnected with all fuses carried by the fuse box for identifying a blown fuse. The LED's are interconnected with the fuses between the positive (current in) input and ground. When a fuse is blown, the fuse results in an open circuit and the flow of electricity is rerouted through the LED to illuminate the LED. Also provided is a liner which fits over an existing fuse box and includes receptacles for fuses with corresponding LEDs associated with each receptacle for indicating a blown fuse. Also provided are individual liners for individual fuses. The individual liner is sized and configured to accept a fuse therein on a first side, and to extend into a fuse box on a second side thereof. The individual liner includes a LED interconnected therewith for indicating a blown fuse. Also provided is a remote indicator having a plurality of indicators positioned away from a fuse box. Additionally provided is a remote fuse box.

14 Claims, 5 Drawing Sheets

BLOWN FUSE INDICATOR

BACKGROUND OF THE INVENTION

1. Field of the Invention

This invention generally relates to an apparatus for indicating that a fuse has been blown, and more specifically to such an apparatus that may be retrofitted to an existing fuse box to indicate that a fuse has been blown.

2. Related Art

Fuses are employed in many electrical systems that are used by people on an everyday basis. For example, fuses are part of electrical systems found in automobiles, boats, motorcycles and other vehicles. These fuses function to stop electricity from flowing to a particular component of the system by creating an open circuit as a result of an unsafe electrical condition. However, these fuses have definite life spans, and after a period of time they burn out, leaving an open circuit which interrupts the flow of electricity to an appliance or a component of a system. In order to reinstate the flow of electricity, and bring the component of appliance back on, the blown fuse must be located and then replaced with another working fuse.

In many cases, all of the fuses for a system are grouped together at one fuse box. The fuse box may or may not be located in an easily accessible place. Typically, the fuse box is packed with numerous fuses positioned side-by-side, and it is therefore difficult to determine which of the numerous fuses is indeed blown. Conventionally, a chart, or map, is supplied with the fuse box which lists the electrical components corresponding to the various fuses. Accordingly, to locate the blown fuse, one must search the chart for the component that is not working, and then match the chart against the fuse box to locate the blown fuse. Of course, the difficulties inherent in such a system are even more pronounced when one attempts to replace a blown fuse in the dark or without adequate lighting.

In the past, efforts have been made to provide indicators for use in connection with identifying tripped circuit breakers (which work in much the same way as fuses but are merely reset rather than replaced when blown). Further, there have also been efforts made to develop a fuse box that includes indicators for indicating blown fuses. These indicators do not function automatically, but rather must be activated by actuating a switch which closes a circuit to illuminate an LED (Light Emitting Diode) corresponding to the blown fuse.

Examples of such of previous efforts at blown fuse indicators include:

Nasu, et al., U.S. Pat. No. 4,281,322, which discloses a fuse blowing detector for detecting whether any of a plurality of fuses has blown. The detector includes one light emitting diode for each fuse connected between the fuse and its load at one end. The other end is connected along with the other light emitting diodes to a switch, which is connected to an electrical source. When the switch is closed, the light emitting diode corresponding to a blown fuse is not lit.

Ishibashi, et al., U.S. Pat. No. 4,349,813 discloses a blown fuse sensor for use with a rotary rectifier to sense a blown fuse due to a short circuit of the rectifier element involved. A current transformer is connected to a pulse extinction indicator circuit through a pulse transformer. When no current flows through the circuit for a predetermined time, the pulse extinction detection circuit produces a signal indicating a blown fuse.

Graves U.S. Pat. No. 4,484,185 discloses a safety plug adapter which includes an over-current protection device, such as a circuit breaker or fuse within the adapter housing. The adapter includes a light emitting device for indicating whether the electric receptacle engaged by the adapter is energized.

Guim U.S. Pat. No. 4,673,928 discloses a warning light for indicating blown fuse caps. The device has a photosensitive circuit mounted inside an adapter which mounts over the fuse element in a round fuse cap. The device further includes a battery to power the device.

Vila-Mascot U.S. Pat. No. 4,760,384 discloses light emitting diode indicator circuit for use with circuit breakers. The circuit includes a capacitor and a LED and is connected in series with the main breaker switch and parallel to the circuit breaker. When a circuit breaker blows, the LED is illuminated to indicate which of a plurality of circuit breakers has blown.

Tucker U.S. Pat. No. 5,002,501 discloses an electrical plug containing a fuse and a LED to indicate that power is on.

Jones, et al. U.S. Pat. No. 5,002,505 discloses a fuse holder for a cartridge fuse. The fuse holder includes a visual indicator in the form of an LED to indicate a blown or missing fuse.

Plass U.S. Pat. No. 5,242,318 discloses a multipole connector for electronic signal lines having filter inserts that function as low pass filters.

Buhr U.S. Pat. No. 5,306,180 discloses an electrical connector provided with an electrical interconnection between respective portions of its contacts.

Wilheim U.S. Pat. No. 5,331,505 discloses a multicoplanar capacitor for an electrical connector for limiting radiation from affecting the operation of electronics.

Paulus U.S. Pat. No. 5,336,115 discloses a surge suppression filter contact connector for enabling removal of an individual surge suppression contact from the mating front end of the connector.

Nguyen U.S. Pat. No. 5,340,334 discloses a filtered electrical connector for providing protection against electromagnetic interference.

None of these previous efforts disclose all of the benefits and advantages of the present invention, nor do these previous patents teach or suggest all of the elements of the present invention.

OBJECTS AND SUMMARY OF THE INVENTION

It is a primary object of the present invention to provide an indicator for indicating a blown fuse.

It is another object of the present invention to provide a indicator which automatically indicates a blown fuse.

It is another object of the present invention to provide an indicator having LED's corresponding to fuses, which LED's are automatically illuminated when a corresponding fuse is blown.

It is another object of the present invention to provide a blown fuse indicator which can be retrofitted to an existing fuse box.

It is even another object of the present invention to provide a blown fuse indicator which can be positioned between an existing fuse box and existing fuses.

It is even another object of the present invention to provide a blown fuse indicator which can be retrofitted with an existing fuse box on a fuse by fuse basis.

It is still another object of the present invention to provide a blown fuse indicator that fits over an existing fuse box, the blown fuse indicator including, on one side thereof receptacles for receiving fuses, and on the other side thereof protrusions for extending into receptacles positioned on a fuse box.

It is yet another object of the present invention to provide a blown fuse indicator for receiving a single fuse on one side thereof and for extending into a receptacle of a fuse box on the other side thereof.

It is also an object of the present invention to provide a method for converting a conventional fuse box into fuse box that indicates blown fuses.

It is even another object of the present invention to provide a blown fuse indicator which can be positioned remotely from a fuse box for easy access.

It is still even another object of the present invention to provide a blown fuse indicator along with fuse receptacles at a remote location from an existing fuse box.

These and other objects are achieved by the apparatus of the present invention which comprises a fuse box having LED's interconnected with all fuses carried by the fuse box. When a fuse is blown, a corresponding LED is illuminated to identify the blown fuse to allow for quick and easy replacement. The LED's are interconnected with the fuses between the positive (current in) input and ground. Accordingly, when a fuse is blown, the fuse results in an open circuit and the flow of electricity is rerouted through the LED.

In another embodiment of the invention, the blown fuse indicator comprises a liner which fits over an existing fuse box. The blown fuse indicator of this embodiment includes, on one side thereof, receptacles for receiving fuses. The receptacles are sized and configured to receive fuses therein. On the other side thereof, the blown fuse indicator of this embodiment includes protrusions which extend into the fuse receptacles of the fuse box. The protrusions are in electrical communication with the fuse box wiring such that when a fuse is inserted into the liner, the fuse is interconnected with the electrical circuitry of the system and the fuse functions in the same manner as a conventional fuse with a conventional fuse box. Importantly the liner of this embodiment includes an LED associated with each fuse receptacle for indicating blown fuses.

In still another embodiment of the present invention, the blown fuse indicator comprises individual liners for individual fuses. This individual liner is sized and configured to accept a fuse therein on a first side, and is sized and configured to extend into a fuse box on a second side thereof. The individual liner places the fuse into electrical communication with the circuitry of the fuse box such that the fuse operates in a conventional manner. Further, the individual liner includes a LED interconnected therewith for indicating a blown fuse.

In still a further embodiment of the present invention, the blown fuse indicator can be positioned remotely from a fuse box for permitting easy access and visibility to the indicator. In still even a further embodiment of the present invention a remote fuse box can be positioned away from the main fuse box to provide easy access to the fuses and/or to indicators associated therewith.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
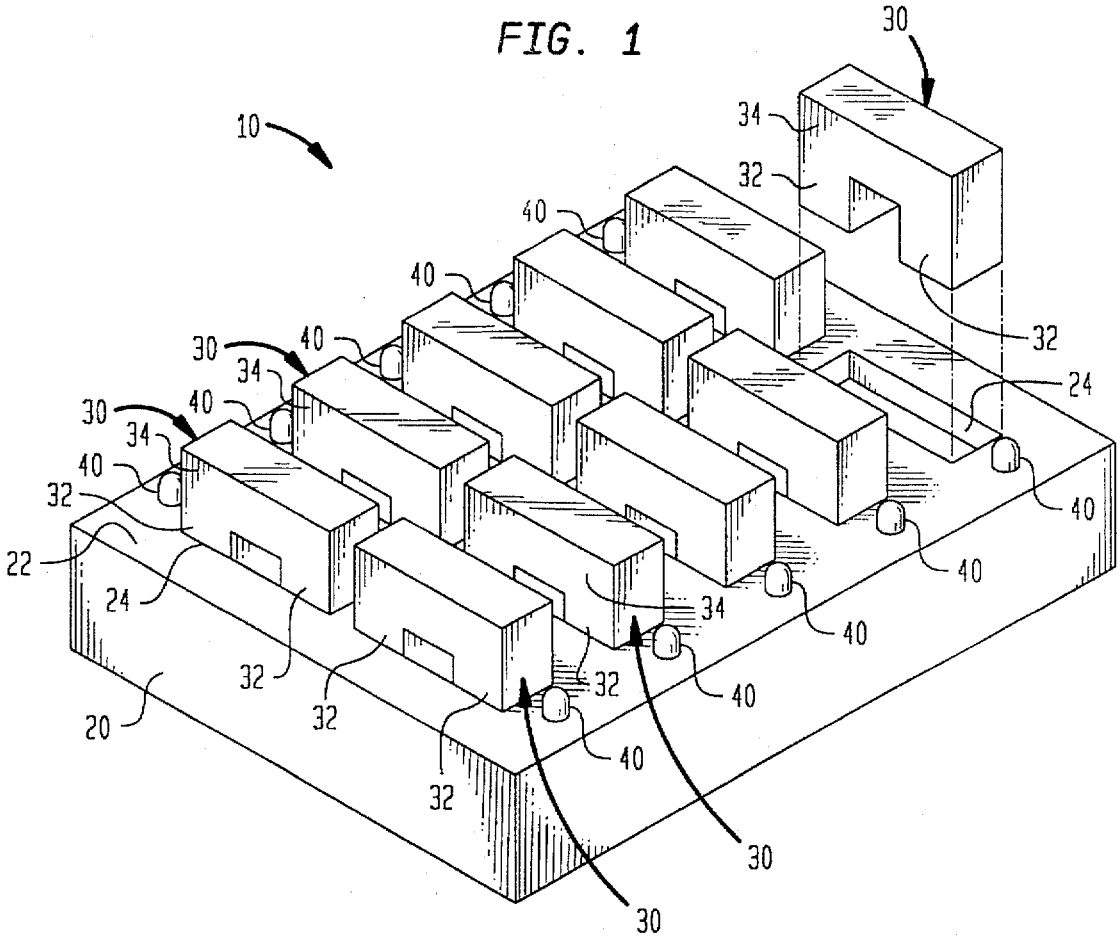
FIG. 1 is a perspective view of the blown fuse indicator of the present invention in connection with a fuse box.

Referring to FIG. 1, the blown fuse indicator of the present invention is generally indicated 10. The blown fuse indicator 10 comprises a fuse box generally indicated at 20, having an upper surface 22 with receptacles 24 formed thereon. The receptacles 24 are sized and configured to accept fuses, generally indicated at 30, as is known in the art. The fuses 30 include legs 32 and bodies 34 interconnected therewith.

As is known in the art, fuses are normally positioned within electrical systems between the electrical source and the electrical components of a system. Typically a fuse box is employed for accommodating all of the fuses employed in a system at one location. The bodies 34 of the fuses 30 carry an electrical resistance strip for monitoring the flow of electricity therethrough. Should the flow of electricity exceed a predetermined level, the resistance strip burns out to create an open circuit to thereby cut off the flow of electricity to a system component. The electrical resistance strip of the fuse 30 is electrically interconnected with the fuse legs 32 which in turn are interconnected within the electrical system between the electrical source and an electrical component. Accordingly, one leg 32 of the fuse 30 acts as an electrical positive while the other acts as an electrical negative.

Also interconnected with the fuse box 10 and the electrical system are LED's 40. Importantly, the LED's or light emitting diodes can equally be comprised of any other indicating signal means such as a light or any other such means. The LED's 40 are arranged along the fuses 30, one LED 40 corresponding to each fuse 30. Alternatively, one LED 40 could correspond to a plurality of fuses 30 to indicate that one of a plurality of fuses 30 is blown. The LED's 40 are connected at one end to a positive leg 32 of a fuse 30 or an electrical line leading from the electrical source to the fuse, and at the other end to the other leg 32 of the fuse 30 or to negative or ground.

In normal operation of the electrical system, electricity flows from the electrical source, through the fuse box 20, through the fuse 30 to the electrical component. If the fuse blows, the flow of electricity is re-routed to flow from the electrical source, to the LED 40 associated with the blown fuse 30, to ground, to illuminate the LED 40 to identify the blown fuse 30. Upon replacement of the blown fuse with a working fuse, the electricity is re-routed back to flow through fuse 30, and the LED 40 returns to being dormant.

Figure 2:
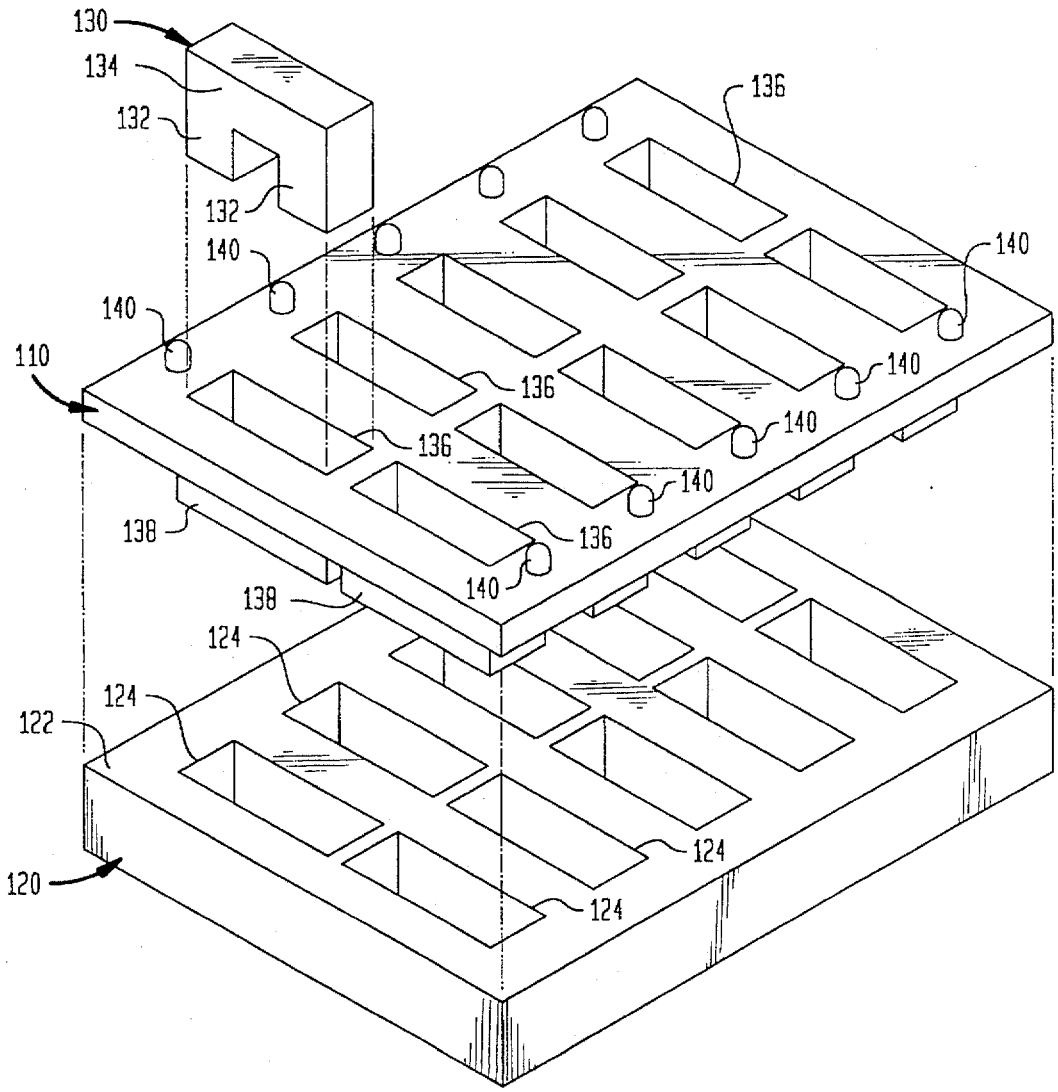
FIG. 2 is partially exploded perspective view of another embodiment of the blown fuse indicator of the present invention for interconnecting a conventional fuse with a conventional fuse box.

Referring now to FIG. 2, another embodiment of the blown fuse indicator of the present invention is shown. The blown fuse indicator of this embodiment may be used in connection with an existing conventional fuse box. In this embodiment, the blown fuse indicator is generally identified at 110 and comprises essentially a liner for placement between a conventional fuse box 120 and a fuse 130. As such, the liner 110 includes a plurality of receptacles 136 corresponding to the plurality of receptacles 124 on the upper surface 122 of the fuse box 120. The receptacles 136 are sized and configured to accept fuses 130 therein in the normal manner known in the art, i.e. fuse legs 132 are inserted into the liner 110, the body 134 of the fuse 130 extending up from the liner 110.

The liner 110 further includes protrusions 138 extending from a lower side of the liner 110. These protrusions 138 correspond to the receptacles 136 formed on an upper surface of the liner 110. These protrusions 138 are sized and configured to extend into and be received by the receptacles 124 in the fuse box 120. Further, the protrusions 138 include electrical contacts (not shown) for electrical communication with the electrical components of the fuse box 120. Additionally, the contacts on the protrusions 138 are in electrical communication with contacts within the receptacles 136 which engage contacts on the legs 132 of the fuses 130. Accordingly, the fuse 130 is put into electrical communication with the fuse box 124 through the liner 110.

The liner 110 further includes indicators 140 positioned to correspond to the receptacles 136 in the liner 110. As in the previous embodiment, the indicators 140 are preferably LED's though any other indicating means known in the art could be employed. The indicators 140 include electrical leads which are interconnected within the liner 110 to electrically communicate the LED's with the electrical system with which the fuse box is employed at one and with ground at the other end. Importantly, additional electrical components can be included as desired throughout the system, i.e. resistors or capacitors or any other desired electrical components can be utilized in connection with the LED's. Additionally, in the case of the liner 110, it may be necessary to include a ground strip or conduit (not shown) within or attached to the liner 110. The indicators 140 would be interconnected by one lead thereof to the ground strip. The ground strip would extend from the liner 110 and would be capable of being grounded on the exterior of the liner 110. As such, upon a fuse 130 being blown, the corresponding indicator would receive electrical current and would be illuminated to identify the blown fuse.

Figure 3:
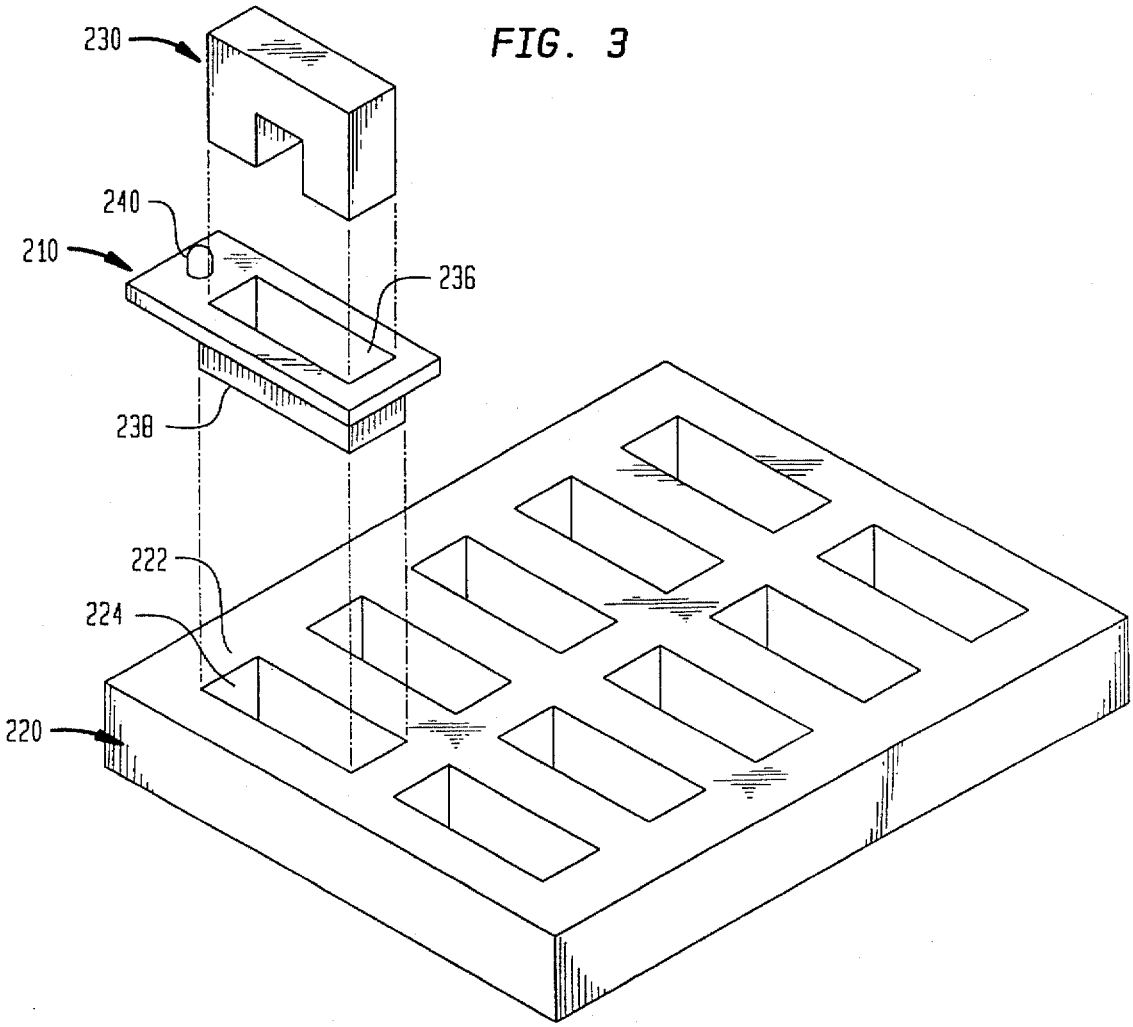
FIG. 3 is a partially exploded perspective view of the another embodiment of the blown fuse indicator of the present invention for interconnecting individual fuses with conventional fuse boxes.

Referring now to FIG. 3, another embodiment of the blown fuse indicator of the present invention is shown. The blown fuse indicator of this embodiment can also be used in connection with an existing conventional fuse box. In this embodiment, the blown fuse indicator is generally identified at 210 and comprises essentially a sleeve for placement between a conventional fuse box 220 and a fuse 230. The sleeve 210 includes a receptacle 236 for receiving a fuse 230 therein. The sleeve 210 further includes a protrusion 238 sized and configured to be received in a receptacle 224 on the upper surface 222 of the fuse box 220. As with the previous embodiment of the present invention, electrical contacts and links are provided to put the fuse 230 into electrical communication with the electrical components of the fuse box.

The sleeve 210 further includes an indicator 240 positioned thereon. As in the previous embodiment, the indicator 240 is preferably a LED, though any other indicating means known in the art could be employed. The indicator 240 includes an electrical lead interconnected to the electrical system within the sleeve 210 to electrically communicate the LED with the electrical system within the fuse box 220. Another electrical lead of the indicator 240 is interconnected with ground. When the fuse 230 is blown, the indicator receives electrical current and is illuminated to identify the blown fuse.

It should be pointed out that the blown fuse indicator of the present invention can interconnected with various hardware items to further expand the capabilities of the indicator. For example, the device can be interconnected with a switch such that an indicator indicating a blown fuse is activated only upon actuation of the switch. Alternatively, the indicators could be wired to a switch such that actuation of the switch illuminates all indicators except any indicator associated with a blown fuse. This would allow one to perform periodic fuse checks on all fuses in the system. Additionally, the blown fuse indicator of the present invention could be used in connection with an audio alarm or indicator which would create an audible audio signal upon the occurrence of a blown fuse to alert one that a fuse has been blown. Other additions and modifications are also considered to be within the scope of the present invention.

Figure 4:
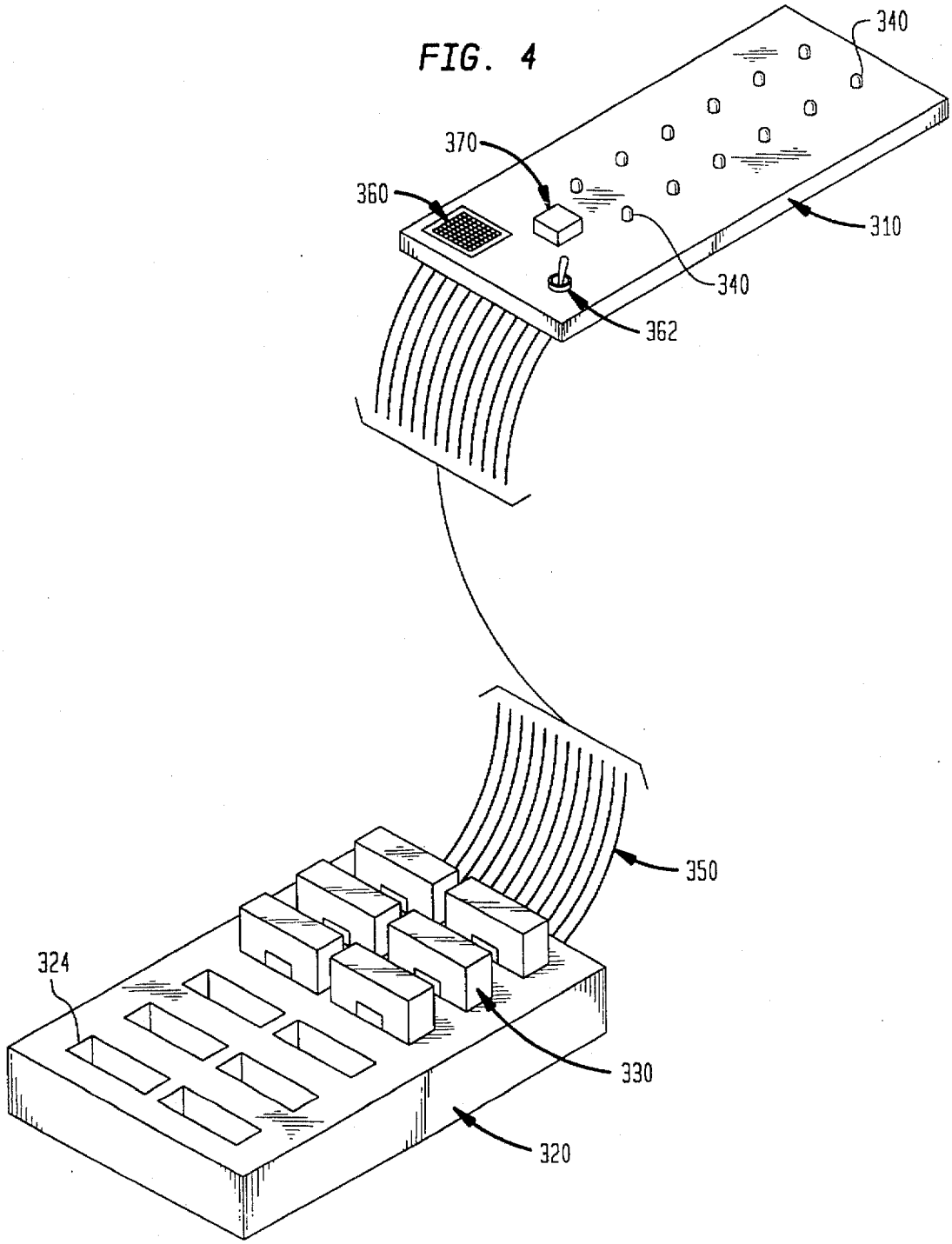
FIG. 4 is a perspective view of another embodiment of the blown fuse indicator of the present invention showing a remote indicator panel for use with a conventional fuse box.

Referring now to FIG. 4, another embodiment of the blown fuse indicator of the present invention is shown. In this embodiment, the indicator portion of the device, generally indicated at 310, is positioned remotely from the existing fuse box 320. Accordingly, the existing fuse box 320, which includes receptacles 324 for receiving fuses 330 therein, may be retained in its existing place or positioned in an out-of-the-way place. Leads 350 are interconnected between the fuse box 320 and the remotely positioned indicating device 310 to electrically connect the fuses 330 with indicators 340 on the indicating device 310. The indicating device 310 may comprise nothing more than a thin block of material supporting a plurality of indicators 340.

The electrical connection of the indicators 340 and the fuses 330 is accomplished in accordance with the description of the previous embodiments, the only variation being that leads 350 are required to deliver the electrical signal from the fuse box 320 to the indicators 340 on the indicator device 310. The electrical connection between the fuses 330 and the indicators 340 could merely include one lead from each of the fuses 330 at the accessory side of the fuse leading to the negative sides of the LED indicator 340. The positive sides of the LED indicators 340 could then each be connected together to a common positive. As with the earlier embodiments of the blown fuse indicator of the present invention, an audio alarm 360 may be included on the indicator device 310 to provide an audible signal that a fuse 330 has been blown. Further, an on/off switch 362 may be interconnected audio alarm 360 to permit the audio alarm 360 to be turned on or off depending upon the preferences of the user. Additionally, a test button 370 could be installed and electrically interconnected with the indicator elements 340 for periodic checking of the working order of the indicator elements 340.

Figure 5:
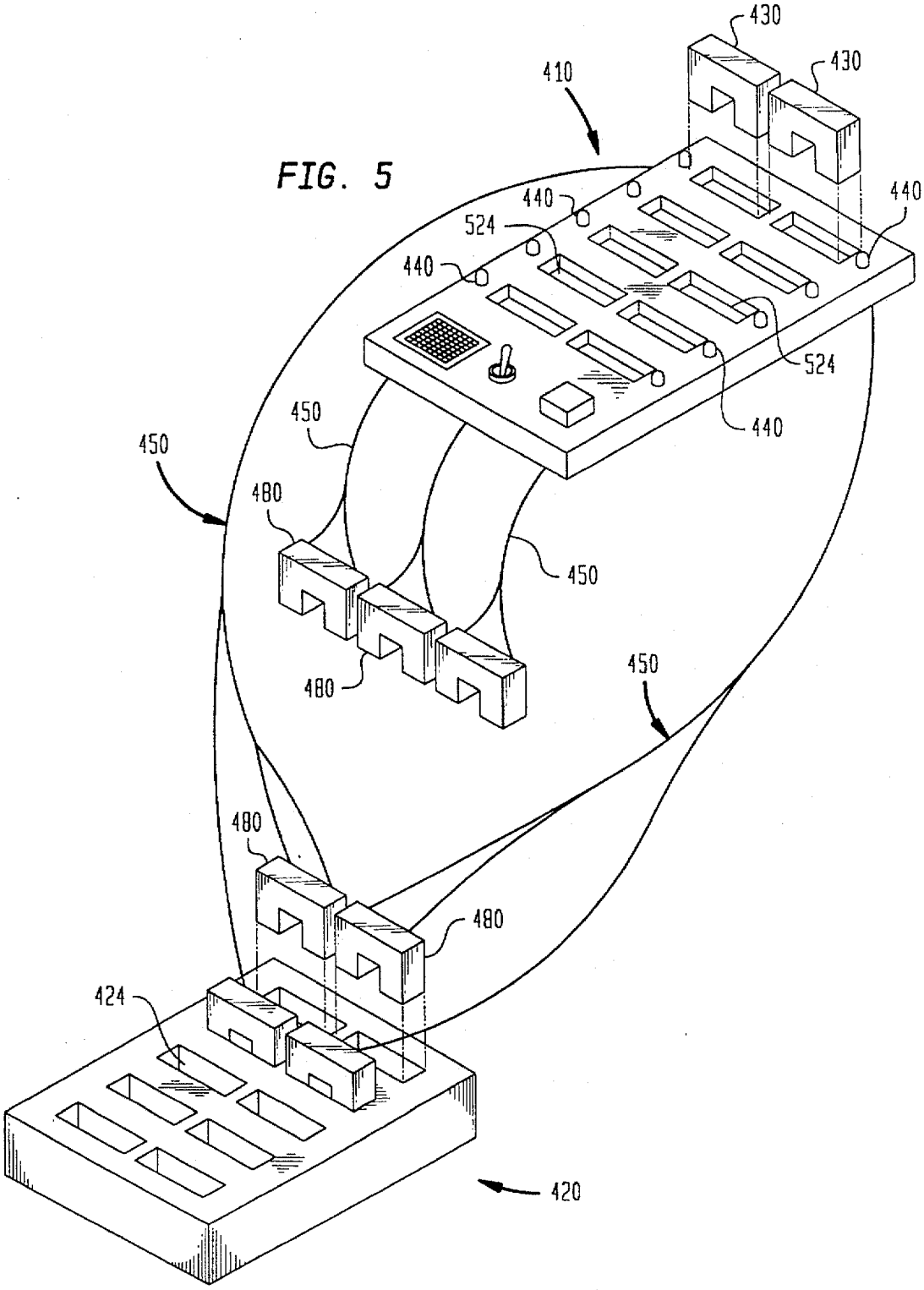
FIG. 5 is perspective view of another embodiment of the blown fuse indicator of the present invention showing a remote fuse box with indicators associated therewith.

Referring now to FIG. 5, another embodiment of the blown fuse indicator is shown. In this embodiment, like the embodiment shown in FIG. 4, the indicator 410 is positioned remotely from the fuse box 420. The indicator 410 and the fuse box 420 are also interconnected by means of leads 450. However, the fuses 430 are received in the indicator device 410 rather than in the fuse box 420. Inserts 480, which are not fuses, are inserted into the receptacles 424 in the fuse box 420. These inserts 480 are configured as fuses but do not include fuse elements. Rather, the inserts 480 electrically connect with the electrical circuitry of the fuse box 420. Leads 450 are electrically interconnected with the inserts 480 and extend to the indicator device 410 to electrically connect the indicator device 410 with the fuse box 420.

The indicator device 410 is constructed to hold indicators 410 and additionally to hold fuses 430 which may be received in receptacles 524. The receptacles 524 are electrically interconnected with the leads 450 which extend to the fuse box 420 to electrically connect the fuses 430 with the fuse box 420. The indicator device 410 also includes indicators 440, which are preferably LEDs, as set forth above with respect to other embodiments of the blown fuse indicator of the present invention. Additionally the LED indicators 440 are electrically interconnected with the fuses 430 as has also been previously described. Further, it should be pointed that the additional accessories described with respect to the previous embodiments including speakers and switches can certainly be included in this embodiment of the invention.

Having thus described the invention in detail, it is to be understood that the foregoing description is not intended to limit the spirit and scope thereof. What is desired to be protected by Letters Patent is set forth in the appended claims.

What is claimed is:

1. A liner for a fuse box comprising:

an upper side having a plurality of fuse receptacles for receiving fuses therein;

a lower side having a plurality of protrusions corresponding to the plurality of fuse receptacles, the protrusions sized and configured to extend into fuse box receptacles on a fuse box;

a plurality of contacts extending from the exterior of the protrusions to the interior of the fuse receptacles to communicate a fuse positioned within the fuse receptacle with the fuse box; and an indicator positioned on the liner and interconnected with one or more of the fuses for indicating a blown fuse.

2. The liner of claim 1, wherein a plurality of indicators are positioned on the liner, each indicator corresponding to one of the plurality of fuse receptacles for indicating a blown fuse.

3. The liner of claim 2, wherein each indicator is connected between one of the plurality of electrical contacts at one end and to ground at the other end.

4. The liner of claim 3, wherein each indicator comprises an LED which is electrically connected to a fuse and which is illuminated to indicate a blown fuse.

5. The liner of claim 4, wherein each indicator is interconnected with a ground strip formed on the lower side of the liner for grounding the indicators.

6. The liner of claim 5, wherein the protrusions are sized to be received by the fuse box receptacles in a press-fit relationship for securing the liner to a fuse box.

7. The liner of claim 5 further comprising means for attaching the liner to a fuse box.

8. The liner of claim 1 further comprising a speaker electrically interconnected with the indicator for providing an audible alarm indicating a blown fuse.

9. The liner of claim 7 further comprising a switch electrically interconnected between the indicator and the speaker for activating and deactivating the audio alarm.

10. The liner of claim 1 further comprising a test switch electrically interconnected with the indicators for testing the indicators.

11. A sleeve for a fuse comprising:

a receptacle defined by four sides and a bottom for receiving a fuse therein;

a protrusion formed on the bottom for engagement with a fuse box;

contacts within the receptacle for engaging contacts on a fuse, the contacts extending through the sleeve to the protrusion for electrical engagement with a fuse box;

an indicator formed on the sleeve for indicating a blown fuse, the indicator connected between the contacts.

12. The sleeve of claim 11, wherein each indicator is connected between an electrical contact corresponding to a protrusion at one end and to ground at the other end.

13. The sleeve of claim 12, wherein each indicator comprises an LED which is electrically connected to a fuse and which is illuminated after the fuse is blown.

14. The sleeve of claim 13, wherein the protrusions are sized to be received by the fuse box receptacles in a press fit relationship for securing the liner to a fuse box.

* * * * *